US005797815A

United States Patent [19]

Goldman et al.

[11] Patent Number: 5,797,815

[45] Date of Patent: Aug. 25, 1998

[54] POP-OPEN THROWING TOY WITH CONTROLLABLE OPENING DELAY AND METHOD OF OPERATING SAME

[75] Inventors: Michael J. Goldman, Moorestown, N.J.; James O. Kuhn, Sonoma, Calif.; Richard P. Christen, Sandy, Oreg.

[73] Assignee: Goldman Toy Group, Inc., Moorestown, N.J.

[21] Appl. No.: 795,756

[22] Filed: Feb. 6, 1997

[51] Int. Cl.[6] ..... A63H 27/00

[52] U.S. Cl. ..... 473/588; 473/572; 473/593; 446/487; 446/46

[58] Field of Search ..... 473/588, 589, 473/593, 595, 572, 613; 446/486, 488, 487, 46, 177

[56] References Cited

U.S. PATENT DOCUMENTS

| | | | |
|---|---|---|---|
| 2,952,460 | 9/1960 | Ellis | 446/486 |
| 2,968,121 | 1/1961 | Pearson, Jr. et al. | 446/177 |
| 3,113,396 | 12/1963 | Collins | 446/46 |
| 3,758,985 | 9/1973 | Heisler | 473/588 |
| 4,135,325 | 1/1979 | Lehman | 446/46 |
| 4,196,882 | 4/1980 | Rognon | 248/205.9 |
| 4,607,875 | 8/1986 | McGirr | 248/205.9 |
| 4,790,714 | 12/1988 | Schnapp | 446/486 |
| 4,794,024 | 12/1988 | Crowell et al. | 446/488 |
| 4,955,841 | 9/1990 | Pastrano | 446/487 |
| 5,090,569 | 2/1992 | Nissen et al. | 446/486 |
| 5,096,751 | 3/1992 | Duchek | 446/486 |
| 5,123,869 | 6/1992 | Schipmann | 446/46 |
| 5,263,760 | 11/1993 | Sohol | 248/205.9 |
| 5,381,990 | 1/1995 | Belokin et al. | 248/205.9 |
| 5,511,752 | 4/1996 | Trethewey | 248/205.9 |

*Primary Examiner*—Steven B. Wong

*Attorney, Agent, or Firm*—Fitzpatrick, Cella, Harper & Scinto

[57] ABSTRACT

A toy object has an articulated shell structure which can change from a three-dimensional, polyhedral shape into a flattened shape. A biasing device applies force to the shell, that force tending to urge the shell structure into the three-dimensional, polyhedral shape. A holding device holds the shell structure in the flattened shape in opposition to the force applied by the biasing device, and a regulator regulates the period of time for which the holding device holds the shell structure in its flattened shape.

22 Claims, 5 Drawing Sheets

POP-OPEN THROWING TOY WITH CONTROLLABLE OPENING DELAY AND METHOD OF OPERATING SAME

BACKGROUND OF THE INVENTION

1. Field of the Invention

This invention relates generally to throwable toys. More specifically, this invention involves a throwable toy which can change its shape reversibly from a flattened shape to a three-dimensional shape, as well as a method of using such a toy.

2. Description of the Related Art

Configurable toys, which are toys that can change between a first shape and a second shape, have long fascinated people. Typically, such toys can be held in a flattened configuration, and then, when they are released, the toys snap into a second configuration.

For example, U.S. Pat. No. 2,952,460 to Ellis describes a hollow toy ball with a suction cup and a facing plate located opposite each other inside the ball. The facing plate has a scratch or nick. When the ball is compressed, the suction cup comes into contact with, flattens out against, and adheres to the plate. Air pressure inside the ball gradually flows through the scratch to the inside of the suction cup until the ball snaps back to its spherical configuration. The period of time which passes before the suction cup releases is unpredictable and cannot be adjusted.

Another shape-changing toy, as described in U.S. Pat. No. 2,968,121 to Pearson, Jr., et al., takes the form of a fanciful human figure which consists of three telescoping sections; hat, head and body. Internal springs and suction cups are arranged so that when the toy is compressed, the three sections telescope together, holding the toy in the compressed state against the urging of the springs. As time passes, air seeps under the suction cups and eventually the suction cups release, so that the different sections pop up under the urging of the springs. Again, the delay until the suction cups release cannot be varied.

Other shape-changing structures are described in U.S. Pat. No. 4,790,714 to Schnapp and U.S. Pat. No. 4,794,024 to Crowell et al. These patents describe collapsible polyhedral structures which spring back on their own to three-dimensional shapes. Each of these patents suggests using inner elastic bands or strands to cause the flattened structure to spring back to its three-dimensional shape. Spring-back occurs immediately upon release of the flattened object.

Throwable toys such as flying-saucer shaped discs and balls are popular with both children and adults. U.S. Pat. No. 4,955,841 to Pastrano describes a collapsible throwing toy which can change in shape from a flattened disc to a ball-like polyhedron. This toy has an internal elastic member which ordinarily maintains the toy in its three-dimensional form. In use, a person flattens the toy to its disc shape against the urging of the elastic member, and then throws the toy so that it spins. The centripetal force in the spinning toy opposes the urging of the elastic member, to maintain the toy in its flattened shape. As the spinning disc slows, the centripetal force decreases, until the elastic member is able to force the toy back to its ball-like configuration. This toy is not capable of maintaining a flattened shape on its own, however, except when it spins with at least a certain angular velocity.

U.S. Pat. No. 5,123,869 to Schipmann recognizes that by mounting weights selectively, the trajectory of a toy's path when thrown may be altered. However, Schipmann's toy does not pop open.

Unrelated to toys, several different suction cups are known. U.S. Pat. No. 4,196,882 to Rognon suggests a double suction cup holder with vacuum control valve. This suction cup holder has two opposed suction cups which are joined by a neck having a bore therethrough, the bore leading to a flared section of each suction cup. When desired, a valve structure allows the channel and cross channel to communicate with both the suction cups and the atmosphere, destroying the vacuum in the suction cups, and releasing the device from the surfaces to which it is attached.

Other examples of easily released suction cups are described in U.S. Pat. No. 5,263,760 to Sohol and U.S. Pat. No. 6,607,875 to McGirr. Each of these patents depicts suction cup assemblies having slidable handles. The handle controls a valve structure such that when the handle is in a particular position, any vacuum under the suction cup is destroyed, releasing the suction cup from the surface to which it was attached.

U.S. Pat. No. 5,090,569 to Nissen et al. describes a reusable packaging construction suitable for use as a novelty item. This device has a number of pivoting shell parts arranged at regular intervals around a longitudinal axis in which an object can be packaged. That object is concentrically surrounded by an elastic band which is attached to the shell parts. By virtue of this arrangement, the package can be opened and closed to reveal the inner contents.

SUMMARY OF THE INVENTION

An object of the present invention is to provide an object suitable for use as a throwable toy which can change from a flattened shape to a three-dimensional shape at a predetermined time which may be regulated and varied.

Another object of the present invention is to provide a toy object having an articulated shell structure including a top cap, bottom cap, and at least three fingers connecting the top and bottom caps in a manner such that the articulated shell structure can selectively change from a three-dimensional, polyhedral shape into a flattened shape. A biasing means applies force to at least some of the fingers, that force tending to urge the shell structure into the three-dimensional, polyhedral shape. A holding means holds the shell structure in the flattened shape in opposition to the force applied by the biasing means, and a regulating means regulates a period of time during which the holding means holds the shell structure in its flattened shape.

A further object of this invention is to provide a toy object which includes an articulated shell structure having top and bottom caps, and at least three fingers connecting those caps in a manner such that the articulated shell structure can selectively change from a three-dimensional, polyhedral shape into a flattened shape as the top and bottom caps move together along a central axis. An elastic member surrounds the central axis and is attached to at least three of the fingers, the elastic member applying force to at least some of the fingers, that force tending to urge the shell structure into a three-dimensional, polyhedral shape. A releasable lock applies a restraining force to the top and bottom caps to hold the shell structure in the flattened shape in opposition to the force applied by the elastic member. A variable timer causes the releasable lock to apply the restraining force to the shell structure only during a predetermined period of time from zero to infinity. After the predetermined period of time passes, the variable timer causes the restraining force not to be applied, and the elastic member thereby urges the shell structure into the three-dimensional, polyhedral shape.

Yet another object of this invention concerns the provision of a method of changing a configuration of an object, the object having a shell structure deformable between a three-dimensional polyhedral shape and a flattened shape, applying a force to a portion of the shell structure, the force tending to urge the shell structure into the polyhedral shape, holding the shell structure in the flattened shape in opposition to the force applied by the biasing means, and regulating a duration of the holding of the shell structure in the flattened shape.

DESCRIPTION OF THE PREFERRED EMBODIMENTS

Figure 1C:
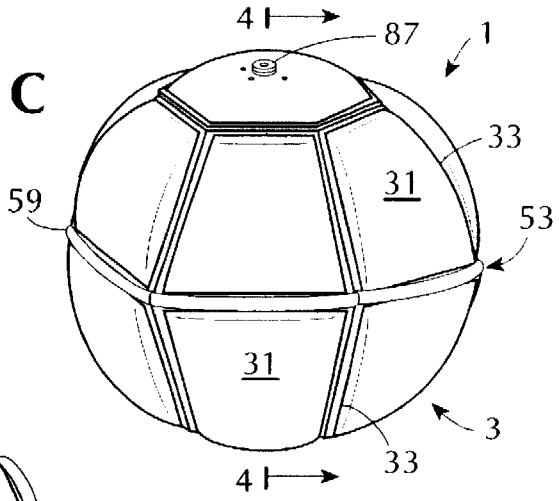
FIGS. 1A–1C are a series of perspective views showing an embodiment of this invention as it changes from a flattened shape to a three-dimensional, polyhedral shape.
Figure 1B:
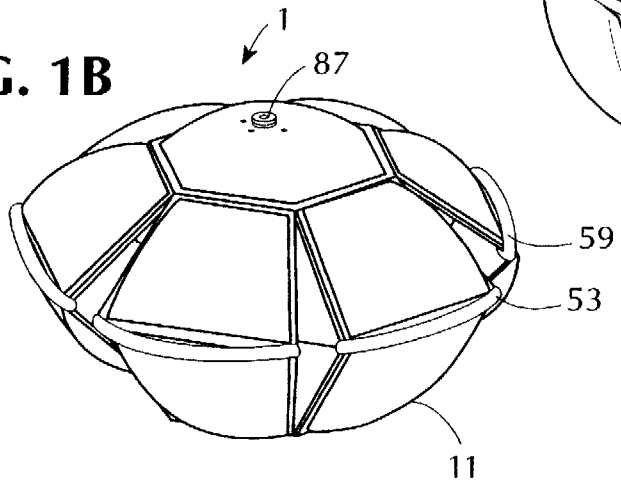
Figure 1A:
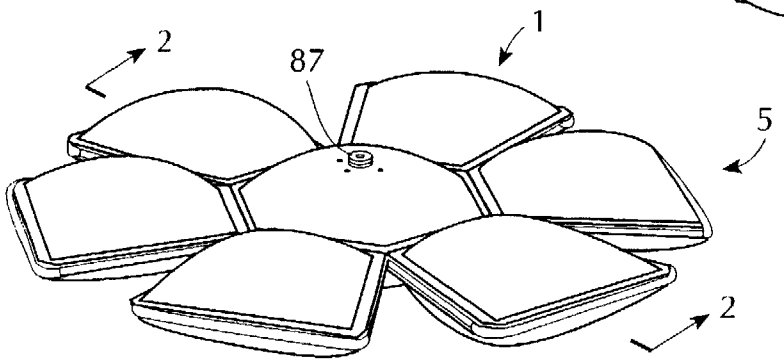

The present invention takes the form of a toy 1 which can change from the shape of a flattened disc 5 to a three-dimensional polyhedron 3. This change in shape is rapid, and so the toy appears to pop open; the toy opens with a noticeable "pop". The user can choose the amount of time which passes before the flattened disc pops open into the polyhedron. The shape change can occur either immediately or after some user-variable and/or predetermined delay period. If desired, the shape change can be prevented from taking place.

The terms "polyhedral" and "polyhedron" are used in their broadest sense, and refer to all possible three-dimensional shapes. For example, the toy may be constructed to have a generally-spherical, ball-like appearance.

This invention includes four general components: (1) an articulated shell structure which can reversibly change from a flattened, disc-like configuration 5 to a three-dimensional polyhedral configuration 3 ("articulated" meaning that portions of the shell structure 11 can be moved relative to one another); (2) an internal biasing assembly which applies force to the articulated shell structure so that the shell structure changes from the disc-like shape to its polyhedral shape; (3) a controllable restraining mechanism which prevents the biasing assembly from causing the shell structure to change shape; and (4) a timer/controller which regulates the effect of the restraining mechanism. Each of these components will now be explained in detail with reference to the accompanying drawings.

As depicted in FIGS. 1A–C and 2–4, this invention includes an articulated shell structure 11. While the shell structure can be formed in a variety of ways, it is thought to be preferable to form the shell using compression thermal forming or injection molding to obtain the two pieces shown in FIG. 6.

Body 13 has a hexagonal center 23 from which radiate six equally-spaced fingers 15 (although six is thought to be the preferred number of fingers, any other suitable number of fingers may be used with an appropriately shaped center). Each finger is joined to the hexagonal center through a living hinge 29; since the hexagonal center and fingers are integral parts of the body, such living hinges can be formed by thinning the material of the finger where it meets the hexagonal center. Alternatively, the material of the finger may be scored. This way, when the finger is bent, it will first deform at the living hinge, since when bending force is applied to the finger, the hinge, with its thinner material, experiences the highest internal forces. Alternatively, any known hinge mechanism, such as a three-piece pinned hinge, may be employed.

Each finger 15 has several living hinges 29 formed along its length. As will be explained in greater detail below, these living hinges allow the finger to change shape from generally flat to approximately curved, and thereby form part of the overall polyhedral shape of the three-dimensional toy.

Figure 6:
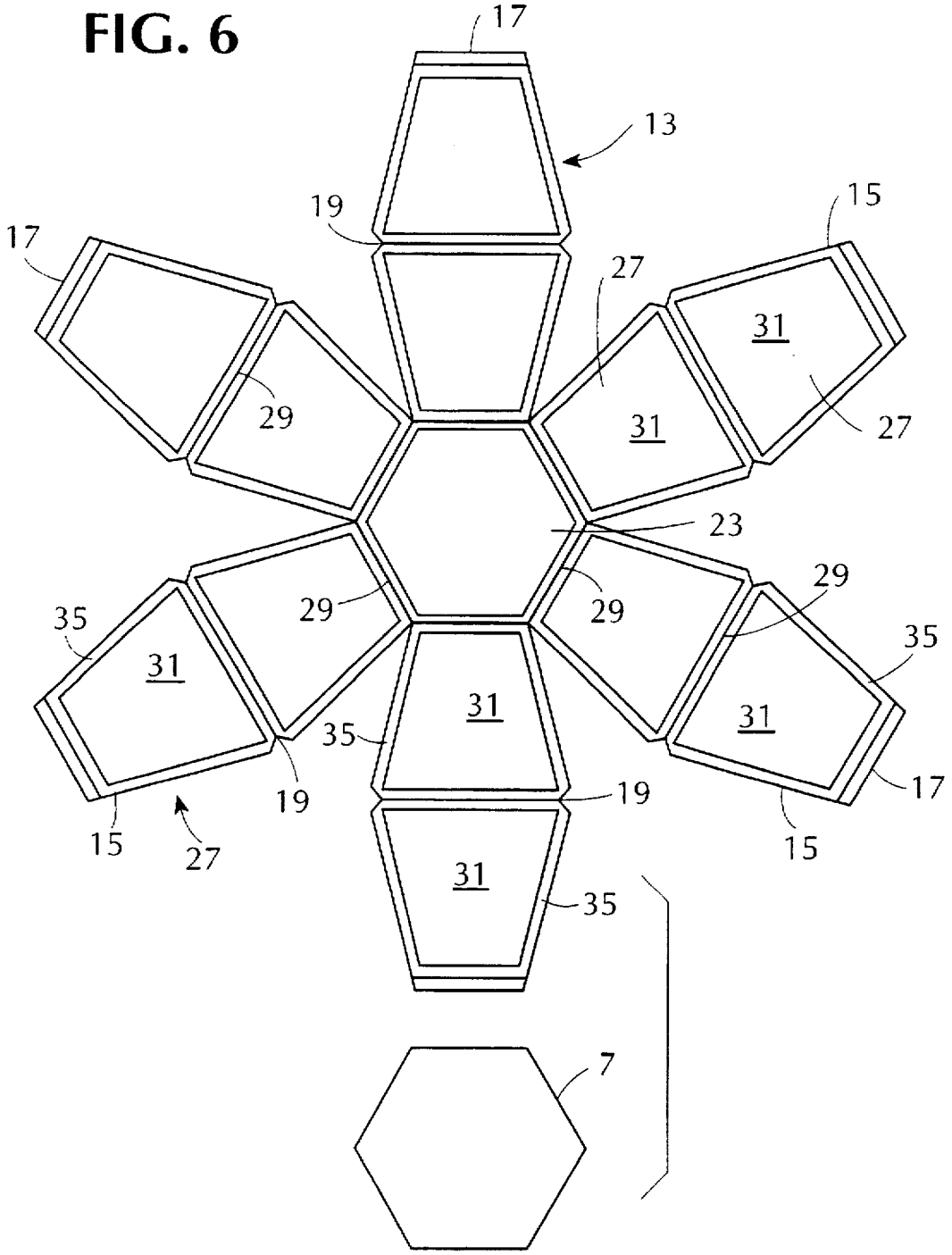
FIG. 6 is a top plan view of the shell structure and cap according to an embodiment of this invention.

In the embodiment shown in FIG. 6, the fingers 15 are about 5 ⅝" long and 3 ⅛" wide at their greatest point 19. The widest part of each finger is its middle. The living hinges are separated from one another by about 2 ½". As seen in profile in FIGS. 2 and 4, the living hinge is about 1/16" thick, whereas the general thickness of the finger is about ⅛"–¼".

The fingers 15 shown in FIGS. 1A–C and 6 are also designed so that the area between adjacent living hinges 29, which takes the form of trapezoidal panels 27, is contoured slightly upward out from the plane in which the hinges all lie when the body is flattened. This contoured region 31 can be designed so that the fingers, when they are bent along the living hinges, form the polyhedral shape. Although it is thought to be preferable for the panels to be trapezoidal, other shapes, such as triangles and rectangles, also may be used.

As shown in FIGS. 1A–C, 3 and 6, a flat border 35 surrounds each raised contoured region 31. This way, the surface of both the flattened shape 5 and polyhedral shape 3 formed by this invention will have a number of surface grooves 33 formed by the flat borders lying between adjacent raised contoured regions 31. The surface grooves can make it easier to grip and throw this invention.

The configuration, dimensions and proportions of the toy 1 shown in all of the accompanying drawings, and described herein, are merely illustrative—any suitable number of fingers 15, and any shape of fingers, may be used, and the toy's size may be changed. Likewise, the number of living hinges 29 may be varied, and the flat borders 35 may be eliminated. The shape of the contoured regions 31 between adjacent living hinges 29 also may be changed.

As previously explained, all of the fingers 15 of the body 13 are joined via living hinges 29 to the hexagonal center 23 of the body 13, such that the body is a single integral part. Seen in side cross-sectional view in FIG. 4, in which the device has taken on its polyhedral shape 3, the hexagonal center is contoured such that it is curved as if it were formed by cutting a hexagon out from a hollow sphere, rather than being flat. This way, when the assembled articulated shell structure 11 is in its three-dimensional, polyhedral shape 3, the hexagonal center will appear to be curved at its bottom, where the fingers 15 of the body 13 are attached to the hexagonal center of the body, via the living hinges.

Figure 2:
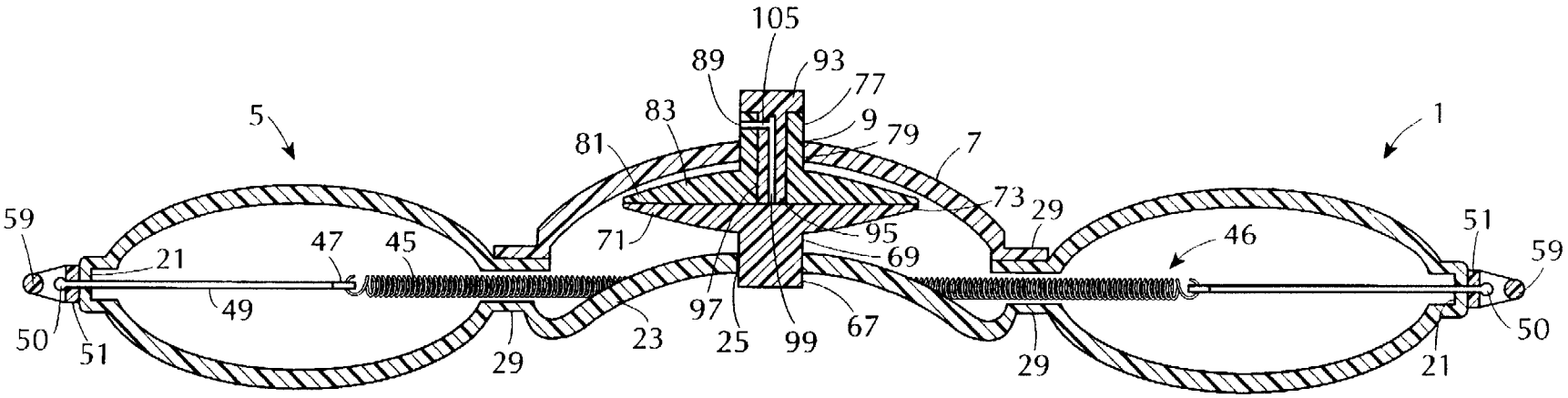
FIG. 2 is a side cross-sectional view of the embodiment of this invention shown in FIG. 1A as seen along line 2—2.

As shown in the side cross-sectional view in FIG. 2, in which the device has taken on its flattened shape 5, the hexagonal center has deformed and is now contoured upward. This occurs because the hexagonal center has been deformed through the force exerted when the two suction cups 67, 77, are joined together, in the manner which will be described. Alternatively, by providing a suitably stiff hexagonal center 23, or stiffeners, or lengthening the necks of the suction cups, the original shape of the hexagonal center may be maintained.

Figure 4:
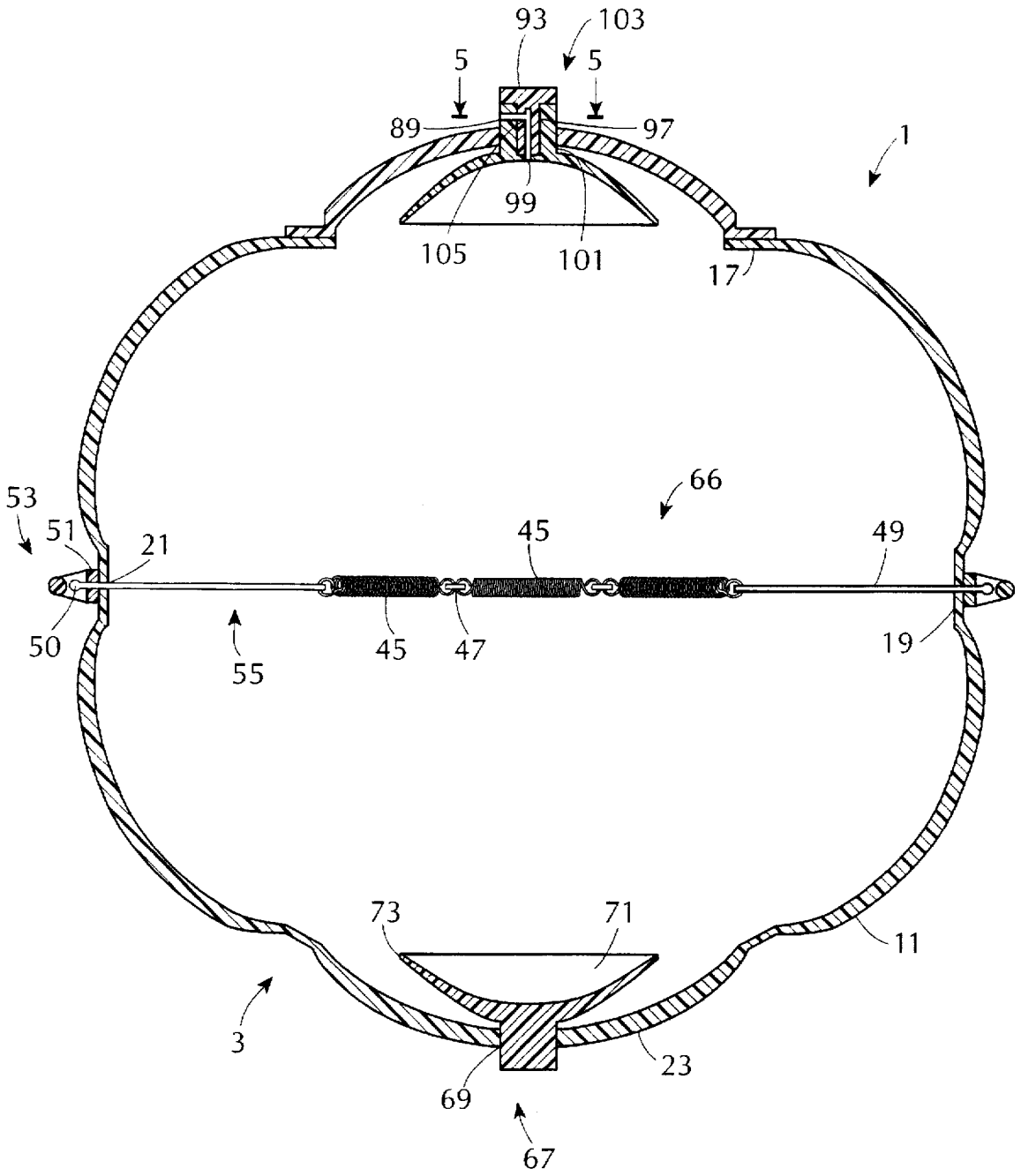
FIG. 4 is a side cross-sectional view of the embodiment of this invention shown in FIG. 1C as seen along line 4—4.

Cap 7 is preferably hexagonal in shape, and for the sake of symmetry, is the same size as the hexagonal center 23 of the body. As with the hexagonal center of the body, and as seen in FIGS. 2 and 4, the cap is curved as if it were part of a the surface of a hollow sphere. This way, when the assembled shell structure 11 takes its three-dimensional shape 3, it will appear to be curved at its top, where the fingers 15 of the body 13 meet the contoured cap. The cap also may differ in size from the hexagonal center of the body, and different size and different shaped parts may be used. For example, the shell structure 11 need not be rounded—any other suitable shape may be provided.

The hexagonal center 23 of the body may have a hole 25 located at its center. Likewise, cap 7 may have a hole 9 located at its center. The reason for having such holes will be explained below.

Figure 3:
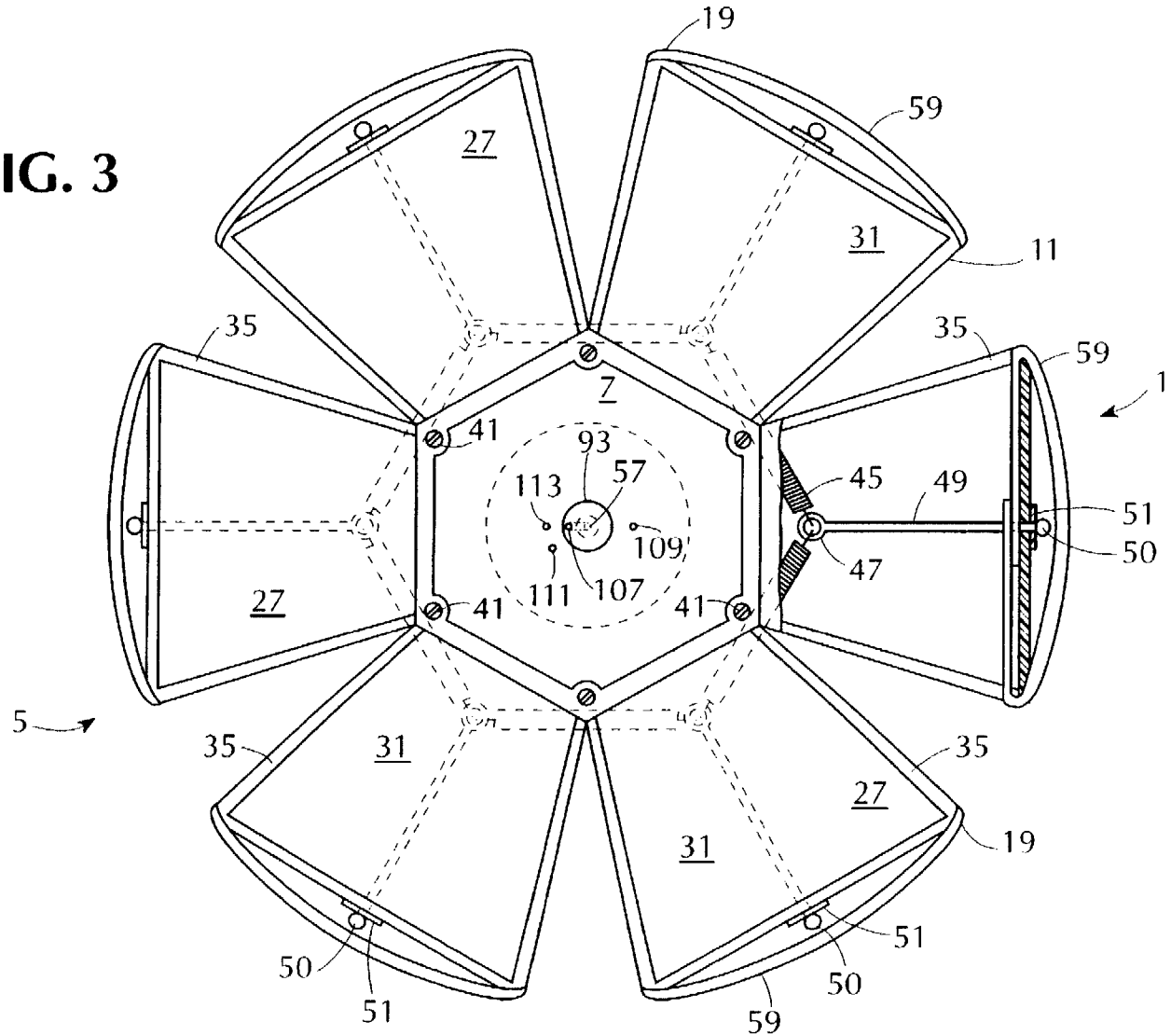
FIG. 3 is a top plan view, with a partial cutaway view of one of the fingers, of an embodiment of this invention.

To assemble the entire articulated shell structure 11 of this invention, the tips 17 of the fingers 15 are joined to the cap 7. Any suitable type of fastening technique can be employed, such as welding, bonding using adhesive, using mechanical fasteners such as rivets, screws or clips, or shaping the fingers and cap to have interlocking projections. One such way of joining the fingers to the caps is shown in FIG. 3, and uses lightweight nylon bolts 41 and nuts (not shown, being obscured by bolts 41), with two bolts and nuts being used to attach each finger to the cap. The bolts and nuts may be put through preformed holes in the tips of the fingers and the cap, or self-starting bolts may be used.

In an alternative embodiment of this invention, the cap 7 may be provided not as a separate piece, but rather, as a part of one of the fingers 15. In that case, a living hinge 29 may be provided between the hexagonal cap and the finger on which it is formed. The other fingers may be joined to the cap in the assembled shell structure 11 in the manner outlined above for the separate cap. Such an integral body may be especially well-suited to formation by compression thermal forming or injection molding.

Flying performance of the flattened object may be improved by increasing the mass around the perimeter of the flattened shell structure. This can be accomplished in many different ways. For example, it is possible to mold the body 13 such that additional mass is placed at the perimeter of the flattened device, or such additional mass could be attached to the body in any suitable manner. For example, dense material could be embedded in the body 13.

As shown in the Figures, one way to add mass is to mount a perimeter weight 59 on each finger 15 (alternatively, only some fingers might carry weights). The perimeter weight can be formed using a length of coated soft metal wire.

Once the fingers 15 are attached to the cap 7, the articulated shell structure 11 can change from a flattened, disc-like shape 5 to a three-dimensional, polyhedral shape 3 as the shell structure bends along the different living hinges 29 of each finger 15. Again, it is thought to be preferable for the polyhedral shape to be as close to spherical as possible, so that the three-dimensional object has the appearance of a ball, but any other suitable shape may be used.

Given that this invention is well-suited for use as a throwing toy, it is preferable to make such a toy light in weight. Consequently, it is desirable to make the body 13 and cap 7 from a stiff, sturdy, yet relatively light material. A preferred material is 6–9 lb. closed-cell cross-linked polyethylene foam of about ¼" thickness, which is formed to shape by a compression thermal forming process. Alternatively, plastic may be injection molded to shape, including the living hinges 29 and flat border 35 or, alternatively, preformed flat sheets of material may be machined or stamped to shape. It will be appreciated that compression thermal forming, injection molding or stamping may be preferable if the number of toys to be made is sufficient to warrant the tooling expenses associated with the construction of molds.

It is preferable that the shell have a pleasing appearance and texture. The shell structure may be colored by impregnating the material from which it is formed with colorant, painting or dyeing it with colorant, or even laminating pre-printed sheet material onto it. Artwork may be attached to the trapezoidal panels, for example, by stenciling, silk-screening or painting. Surface treatments, such as a waterproof coating, which may make the toy especially suited for beach use, may be attached to the surface of the articulated shell. If desired, surface ornamentation such as glitter, beading, streamers, and even fabric may be applied to the foam surface. Surface texturing, such as perforations, corrugations, or even text and images may be provided on the outside of the shell.

When the device is assembled and the fingers 15 are connected to the cap 7, the resulting shell structure 11 has a number of relatively stiff trapezoidal panels 27 separated from one another by flexible living hinges 29 arranged along sections, like sectors extending from pole to pole on the surface of a sphere. Since the alternating trapezoidal panels and living hinges are formed on all of the different fingers of the body 13, and the fingers 15 are not connected to one another, each finger can deform independently of its neighboring fingers.

Once the fingers 15 are joined to the cap, the resulting articulated shell structure 11 preferably deforms by flexing of the living hinges 29. The trapezoidal panels 27 and living hinges 29 can be arranged as shown in FIGS. 1A–C, 3 and 6, and this arrangement enables the shell structure 11 to alternate between the three-dimensional polyhedral shape 3 and a relatively flat disk. As shown in FIG. 2, the living hinges 29 lying on the central plane 55 of the shell structure 11, which are arranged around the polyhedron's equator 53, deform such that the trapezoidal panels 27 on each side of those hinges pivot about the hinge toward one another.

In the embodiment of the invention depicted in FIGS. 2–4, an internal biasing mechanism in the form of an elastic member 46 serves to urge the assembled shell structure 11 into a particular configuration, specifically, by forcing the assembled shell structure into its polyhedral, three-dimensional configuration 3. The biasing mechanism also allows a user to flatten the shell structure as desired by applying force to the shell structure. The biasing mechanism can be constructed as follows.

A number of springs 45 are provided running around a central axis 53, as are a number of bridle rings 47; in the embodiment shown in FIGS. 2–4, the number of springs and rings may be equal to the number of fingers 15. Each end of each spring is connected to a bridle ring, as shown. Thus, each bridle ring has the ends of two different springs connected thereto, and the springs and rings are around the central axis.

A bridle leg 49 extends from each bridle ring 47. Each bridle leg is joined to a corresponding finger 15. As shown in FIGS. 2–4, this can be done by forming a hole 21 in the living hinge 29 of the finger, passing the bridle leg through the hole, and then attaching a "snapping piece", or a fastener 51. Any suitable attachment technique could be used to join the bridle leg to the finger, such as welding, bonding, or using adhesive, and the bridle and finger could be shaped such that they mechanically engage, for example, by providing a suitable hook and loop. Alternatively, the bridle leg and finger may be integral.

Once all of the springs 45 are attached to the rings 47 of the bridles, and the bridle legs 49 are attached to their corresponding fingers 15, the springs will form an array that surrounds the central axis 57 of the shell structure 11. The springs are preferably chosen with lengths such that the springs are elongated and under tension as soon as the device is assembled; this way, the springs seek to shorten their lengths, and so exert tensile forces on the bridle rings.

While the drawings depict springs and bridles, any other suitable devices could be used. For example, elastic bands may be used in place of the springs and/or the bridles, and these bands, as seen from above, may be of any shape, such as round, rectangular, triangular and hexagonal. Any suitable number of springs and/or bridles may be used. The elastic means may be positioned either symmetrically about the central axis or, if the position of suction cups 67 and 68 allows, the elastic means may extend across the central axis of the device.

Alternatively, the elastic member may consist of a circular, hexagonal or other shaped ring, itself either elastic or inelastic, having springs attached thereto, each spring being joined to a corresponding finger in place of the bridle leg, so that the elastic member is connected to the fingers via springs (not shown). It will be appreciated that this construction effectively reverses the roles of the springs and bridles as previously described. For example, six springs could be attached to a circular ring, one spring leading to each finger. The springs could be attached to the perimeter weights 59 through holes in the living hinges.

It is thought to be preferable to have the elastic member 46 lie in a plane, that plane being perpendicular to the central axis 57, and even more preferably, lying along the equator 53 of the polyhedral shape 3 formed by the articulated shell structure 11. Alternatively, the internal biasing mechanism can be positioned away from the central plane of the device.

It is also thought to be preferable to provide the same tension in all the springs 45, and this can be done by employing springs of the same lengths and spring constants, although this feature is not mandatory.

By locating the bridle legs 49 in the central plane 55 of the structure, and attaching those legs to the centers of the living hinges 29, the inward components of the tensile forces are exerted along the bridle leg 49. The tangential components of the force of adjacent springs, however, are cancelled out, due to the geometry of this arrangement, in a manner which will be appreciated by those skilled in the art of force vector addition. The inward force transmitted along the bridle legs to the fingers maintains the shell structure 11 in its three-dimensional, polyhedral configuration 3.

More specifically, each bridle leg 49 exerts an inward pull on the living hinge 29 to which it is attached, and it is this pull which changes the shape of the finger 15 bearing that living hinge. This inward pull moves the living hinge, and the panels 27 to which it is attached, inward toward the center of the shell structure 11, deforming the finger to a generally circular shape. Since the living hinges and panels are connected through other living hinges and panels to the cap 7 and hexagonal center 23, and all of the bridle legs 49 are exerting force on their corresponding fingers 15 around the hexagonal center, the forces applied by the fingers to the cap and hexagonal center are uniformly distributed around those parts. That even 360° force distribution serves to keep the cap and hexagonal center in fixed position on the central axis 57 of the shell structure 11. The shell structure and biasing means thereby cooperate to hold the shell structure in its three-dimensional, polyhedral form 3.

A further part of this invention involves the provision of an assembly 66 which, when the shell structure is collapsed from its polyhedral shape 3 to its flattened state 5, opposes the forces exerted by the elastic member 46 to maintain the flattened shell structure 11 in its flattened configuration.

One way to maintain the collapsed shell 11 in the flattened state 5 is to provide the structure shown in FIGS. 2 and 4. Such structure includes a lower suction cup 67 and an upper suction cup 77, which suction cups face one another. Each suction cup has a neck portion 69, 79 which flares outward to form a flared region 71, 83, and that flared region has around its perimeter a lip 73, 81. Although the term "flared" will be used throughout this specification to describe a portion of a suction cup, that term is being used only as a convenience, and this invention is meant to cover suction cups of all shapes, not just "flared".

The suction cups 67, 77 are preferably arranged so that they both lie on the central axis 57 of the device 1 (the suction cups may be located off-center, but this may not perform as well). When the device flattens from its three-dimensional, polyhedral shape 3, the suction cups move toward each other and eventually meet.

The suction cups 67, 77 may be attached in any suitable manner to the hexagonal center 23 and the cap 7. For example, the lower suction cup 67 can be affixed to the hexagonal center 23 of the shell structure 11 by mounting the neck 69 of the lower suction cup in a hole 25 formed in the hexagonal center 23. The neck may be secured in the hole by welding, using a mechanical fastener, and/or adhesive. For example, a cotter pin or pins may pass through the neck of the lower suction cup (not shown) so that the portion of the hexagonal center surrounding the hole 25 is fixed between the cotter pin and the flared region 71 of the suction cup. Alternatively, an enlarged flange (not shown) could be provided at the end of the suction cup neck, this flange being larger in diameter than the diameter of the hole, and the flange could be forced through the hole (if desired, the flange could be provided with a suitable taper to assist penetration of the hole). Once the flange is fully through the hole, the resilient material of the hexagonal center contracts and prevents withdrawal of the suction cup. The upper suction cup 77 can be mounted in the same manner as the lower suction cup 69.

Alternatively, one or both of the suction cups may be formed directly as a part of the structure of the cap 7 and/or hexagonal center 23.

When the shell structure 11 is flattened, the opposing suction cups 67, 77 meet one another, as shown in FIG. 4. When sufficient force is applied, the suction cups press against each other and their flared portions 71, 83 deform. At least some of the air between the facing suction cups is forced out, and the suction cups will then stick together as a consequence of atmospheric pressure.

Alternatively, one of the suction cups may be omitted. In that embodiment (not shown), the sole suction cup will contact the opposing portion of the inside of the shell structure 11, which opposing portion may have a flat, smooth surface to which the suction cup can adhere.

While the embodiments depicted in the Figures have suction cups located on the central axis of the device, the suction cups may be located in other positions separated by some distance from the central axis of the shell structure. By mounting the suction cups off of the central axis, an elastic member may be provided running across that central axis.

A throwing toy 1 constructed in this manner is especially useful, because the suction cups 67, 77 keep the flattened toy from popping open to its three-dimensional polyhedral configuration 3. If air leaks between the flared portions 71, 83 of the facing suction cups, the vacuum between those cups would be reduced, and eventually, the suction cups would no longer adhere to one another with enough force to oppose the biasing means. At that point, the throwing toy will snap open to the polyhedral configuration.

The throwing toy 1 of this invention may have a mechanism for controlling or regulating the manner in which the toy opens which is "pre-set" during manufacture. Such a control or regulating mechanism may involves providing a hole of particular size running through one of the suction cups to the space between those suction cups. Air flowing through the hole into the space results in the toy's popping open; the period of time which passes until such opening may be random, or constant, depending upon the characteristics of the toy. The time until opening is controlled because it is at least in part a function of the size of the hole which is provided.

A further embodiment of this invention enables a user to control and if desired vary the manner in which the suction cups 67, 77 adhere to one another. At one extreme, the user can choose to have no adhesion between the suction cups, meaning that the flattened toy 5 will pop back to its polyhedral shape 3 as soon as the flattening force applied thereto is removed. At the other extreme, the user can cause the suction cups to adhere together in an essentially permanent manner, meaning that the flattened toy will hold its flattened state indefinitely after the flattening force applied thereto has been removed (this, of course, assumes no leakage of air into the volume between the suction cups). The user also can select intermediate states such that the adhesion between the opposed suction cups gradually decreases. When that adhesion is no longer sufficient to oppose the force exerted by the biasing means, the toy will pop open to its polyhedral shape.

The intermediate state is of interest because it operates as a time delay. The time delay makes the toy 1 more exciting, since a user can throw the flattened toy 5, which will then pop open to its three-dimensional polyhedral shape 3 after it has been thrown. Two people playing a throwing game might throw the toy back and forth, each flattening the toy before throwing it and trying to have the flattened toy snap open to its polyhedral shape 3 just before it reaches the other person.

One way to provide for the gradual reduction in adhesion between the facing suction cups 67, 77 is to provide a regulator 87 which allows for the gradual flow of air between the facing suction cups.

The embodiment shown in FIGS. 1A–C and 2–5 uses a control valve 91 to vary the flow of air between the suction cups 67, 77. When the valve is fully-closed, air cannot flow into the volume between the flared portions 71, 83 of the suction cups at all, hence, the toy 1 remains collapsed in the flattened state 5. When the valve is fully-opened, air immediately flows into the volume between the suction cups, and the toy pops open immediately and cannot be made to stay flattened. If the valve is set to a position somewhere between the extremes of fully-closed and fully-opened, air gradually flows into the volume between the suction cups, providing a delay until the toy pops open.

Figure 5:
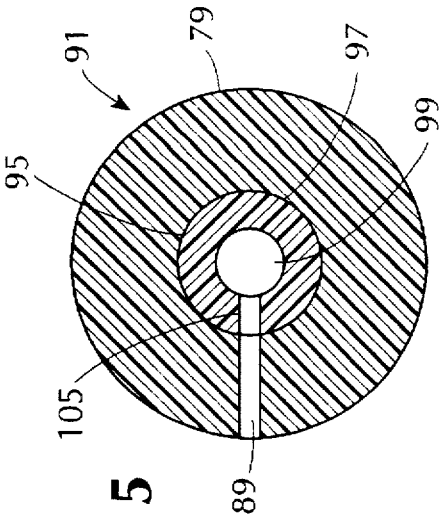
FIG. 5 is a top cross-sectional view of the valve assembly shown in FIG. 4, as seen along lines 5—5.

One example of such a valve structure 91 is shown in FIGS. 2, 4 and 5. This valve structure is formed by the neck 79 of the upper suction cup 77 and a valve stem 95 which sits in the axial bore of that upper suction cup. The axial bore extends through the entire length of the upper suction cup, from the end of the neck to the inside of the flared portion 83 of that suction cup. The upper suction cup, its axial bore, and the valve stem are all dimensioned such that while the valve stem is free to rotate in the axial bore, there is a substantially air-tight seal between the stem and the bore wall, preventing air from passing therebetween. This seal may be provided, for example, by ensuring a close fit of the valve stem in the axial bore, by using suitably-placed sealing rings (not shown), and/or by providing a viscous agent (not shown) such as grease between the stem and bore.

The valve stem 95 has attached thereto a valve handle 93, which can take the form of a disc having a knurled or roughened edge at its proximal end. The valve stem has an axial bore 99 running along at least a part of its length from the distal end 101 toward the proximal end 103. A transverse bore 105 runs through the valve stem 95 and communicates with the axial bore 99, providing the valve stem with an "L" shaped fluid flow path. The term "fluid" is used in its broadest sense, referring to both liquids and gases.

The upper suction cup 77 has a transverse bore 89 running all the way through its neck 79; this transverse bore extends to the axial bore 97 of the upper suction cup 77. This way, fluid can flow from outside the upper suction cup's neck through the transverse bore 87 and into the axial bore 97 of that upper suction cup.

For this construction to operate as a valve, the transverse bore 105 of the valve stem 95 and the transverse bore 89 in the neck 79 of the upper suction cup 77 have to be positioned in registry, meaning that the bores overlap at least partially, and preferably completely, when the valve stem is suitably positioned in the axial bore 97 of the upper suction cup neck 79. This can be achieved by making the distance between the underside of the disc-shaped valve handle 93 and the center of the axial bore 99 of the valve stem 95 the same as the distance between the end of the upper suction cup neck 79 and the center of the transverse bore 89 in that suction cup neck.

When the valve stem 95 is mounted in the axial bore 97 of the upper suction cup 77, the stem fills the axial bore, and prevents air from flowing through the bore into the suction cup, so long as the transverse bore 105 of the valve stem does not communicate with the transverse bore 89 of the suction cup neck 79. As long as the two bores do not face one another, air cannot flow between them. If, however, the valve stem is rotated in the suction cup neck so that the two transverse bores are in at least partial fluid communication, air can flow from outside the upper suction cup neck through the bore in that neck, into the transverse bore 105 of the valve stem 95, and along the axial bore 99 of the valve stem into the flared region 83 of the suction cup. Should the suction cup be sealed to the lower suction cup 67, that air flow will reduce the adhesion between the suction cups, until the cups release.

With this in mind, it will be appreciated that controlling the degree of overlap between the transverse bores 89 and 105 will regulate how quickly the adhesion between the suction cups 67, 77 is reduced, providing the desired timing mechanism.

To assist users in selecting how the toy 1 will open, the valve handle 93 may be provided with an indicator dot 107, and several indicator marks are provided on the outside of the cap 7 around the valve handle 93. One such indictor mark 109 shows the closed position of the valve 91 at which setting the flattened toy 5 will hold its shape indefinitely. Another mark 113 shows the open position of the valve at which the flattened toy will immediately spring open to its polyhedral shape 3. Still another mark 111 shows the intermediate position which provides for a delay period before which the toy pops open, and even more intermediate marks assisting in setting of the timing mechanism may be provided. By lining up the indicator dot 107 on the valve handle 93 with one of these three indicator marks 109, 111 and 113, a user can control whether the toy will pop open immediately, after some delay, or not at all.

It will be appreciated that other valve structures may be used; in particular, it may be desirable to provide a valve structure having increased sensitivity, so that a user can better regulate the gradual flow of air in the intermediate setting.

Additionally, the advantages of this invention may be achieved with one suction cup in conjunction with a variable control or regulator.

This invention is not to be limited to the above-described timing mechanism. Any other suitable structure may be used which allows a user to control the adhesion between the suction cups or between a suction cup and the opposing portion of the inside shell.

It is also within the scope of this invention to switch the roles of the upper 77 and lower 67 suction cups, so that the timing mechanism is located in the lower suction cup, rather than the upper suction cup.

Although it is believed to be preferable to provide six springs and six bridles for the elastic member, other numbers of springs and bridles may be used. For example, a simpler biasing mechanism (not shown) might employ just three springs and three bridles, the springs being arranged to form an equilateral triangle, rather than a hexagon, about the central axis of the object. Again, each spring would attach to the ring of a bridle, but only three bridles would be used; the three bridle legs would extend outward and be attached to three of the fingers in the same manner as described above in connection with the previous embodiment of this invention. Likewise, a round spring may be used.

Nor must the number of springs be equal to the number of bridles—for example, two springs arranged in parallel may be joined at their ends to the same two bridle rings (not shown). Each bridle also may have multiple legs.

Alternatively, the elastic member may consist of a hexagonal or other shaped ring (such as triangular or round) having springs attached thereto, each spring being joined to a corresponding finger in place of the bridle leg, so that the hexagonal center is connected to the fingers via springs (not shown). It will be appreciated that this construction effectively reverses the roles of the springs and bridles as previously described.

It is also within the contemplated scope of this invention to substitute, in place of the springs and bridles, a single elastic member having the general shape of the springs and the bridles attached thereto (not shown). Such an elastic member may, if replacing the six springs, have a generally hexagonal shape, with legs extending outward from each of the points of the hexagon, and any other shape, such as round or triangular, also could be used. These legs may themselves be either elastic or inelastic, and may be attached to the equatorial living hinges in the manner already described. Such an elastic member may be made by injection molding using a suitably elastic moldable material.

In still another embodiment, by carefully designing the body and cap, in particular, the living hinges in the fingers of the body, and by constructing these parts from the appropriate material(s), it may be possible to take advantage of the natural resiliency of the living hinges and do away with the internal biasing structure. That is, since each living hinge has a "memory", and wants to return to a particular position, the shell structure may be made "self-biasing", for example, by designing the living hinges so that they naturally seek to return to the positions which they have when the shell structure is in its three-dimensional polyhedral state. Applying force to the cap and hexagonal center of the body may cause the shell structure to deform and flatten; reducing or removing that force may allow the natural resiliency and memory of the living hinges to bring the shell structure back to its three-dimensional shape.

It also is within the scope of this invention to reduce, increase or even eliminate the number of perimeter weights arranged on the shell structure. The perimeter weights also may be placed on portions of the fingers other than the widest areas of the fingers, and may be mounted in ways other than that shown. For example, weights may be fastened to the inside of the shell structure, attached to the outside of certain trapezoidal panels, or embedded within the panels.

A variety of other constructions and configurations fall within the scope of this invention. For example, the number of fingers is not to be limited to six; any number of fingers forming a suitable collapsible polyhedron may be used.

Likewise, the number of panels in each finger may be varied; the more panels are provided, the more spherelike will be the resulting polyhedron. As previously noted, such panels need not be trapezoidal, and other suitable shapes such as rectangles, triangles, ovals and even circles may be used.

The trapezoidal panels shown in the drawings all had a slightly convex contour, but this is not to be limiting. Flat or concave panels may be used. If desired, the panels may have an embossed or molded surface texture in order to change the device's appearance, handling and/or aerodynamic properties. Such surface texture might include dots, rings, dimples, grooves, ridges, letters, numbers or images, a waffle pattern, or any other suitable pattern. Alternatively, the surface pattern may be applied, say, by adhering pieces to the surface of the panels.

Although the embodiments described above are all symmetrical with respect to the central plane of the shell structure (that is, the north and south hemispheres of the shell structure are symmetrical), such symmetry is not required. By altering the size and/or number of the trapezoidal panels in each finger, a non-symmetrical shell structure may be provided. Such a structure, when collapsed, may have a shape which has improved aerodynamic properties, owing to its non-flat profile. In constructing such a non-symmetrical embodiment, it may be beneficial to move the biasing means away from its position in the central plane of the device.

Although it is thought to be preferable to construct the cap, fingers, hexagonal center and living hinges of the shell structure using resilient, closed-cell, polymeric foam, any other suitable materials may be used. Examples of such materials include injection molded plastic, whether of the thermoplastic or thermoset type, cardboard, and even paper. If desired, a laminated construction also may be employed. In such a construction, the shell structure may be formed by bonding an outer skin to an inner support. The living hinges may be formed by thinning the outer skin, by cutting the outer skin and not the inner skin, or even cutting the inner skin only. In particular, it may be possible to use a lighter grade of foam in the shell structure by applying a suitable coating material such as a stiffening agent directly to the shell structure.

The regulator of this invention is not to be limited to regulators using suction cups—any other mechanism providing a user with the ability to apply a force opposing the force of the biasing means falls within the scope of this invention. For example, electromagnets may be used in place of the suction cups to oppose the force exerted by the biasing means. A suitable energizing circuit may enable users to control for how long the electromagnets provide such opposing force, whether indefinitely, not at all, or for some selected period of time.

Other variations and modifications of this invention will be apparent to those skilled in this art after careful study of this application. This invention is not to be limited except as set forth in the following claims.

What we claim is:

1. A toy object, comprising:

an articulated shell structure having a top cap, a bottom cap, and at least three fingers connecting said top cap and said bottom cap in a manner such that said articulated shell structure can selectively change from a three-dimensional, polyhedral shape into a flattened shape as said top cap and said bottom cap move together along a central axis;

an elastic member which is attached to at least two of said fingers, the elastic member applying a force to said fingers, the force tending to urge said shell structure into a three-dimensional, polyhedral shape;

a releasable lock which, when the shell structure is deformed to said flattened shape, applies a restraining force to said top cap and said bottom cap, the restraining force holding said shell structure in said flattened shape in opposition to the force applied by said elastic member; and a variable timer which causes said releasable lock to apply the restraining force to the shell structure only during a period of time which can be varied, wherein after the period of time the variable timer causes said restraining force not to be applied, and the elastic member thereby urges said shell structure into the three-dimensional, polyhedral shape.

2. A toy object, comprising:

an articulated shell structure having a top cap, a bottom cap, and at least three fingers connecting said top cap and said bottom cap in a manner such that said articulated shell structure can selectively change from a three-dimensional, polyhedral shape into a flattened shape as said top cap and said bottom cap move together along a central axis;

an elastic member which surrounds said central axis and which is attached to at least three of said fingers, the elastic member applying a force to at least some of said fingers, the force tending to urge said shell structure into a three-dimensional, polyhedral shape;

a releasable lock which applies a restraining force to said top cap and said bottom cap, the restraining force holding said shell structure in said flattened shape in opposition to the force applied by said elastic member; and a variable timer which causes said releasable lock to apply the restraining force to the shell structure only during a predetermined period of time, wherein after the predetermined period of time the variable timer causes said restraining force not to be applied, and the elastic member thereby urges said shell structure into the three-dimensional, polyhedral shape.

3. A toy object as in claim 2, wherein said releasable lock comprises:

a suction cup attached to said top cap, said suction cup facing into said toy object; and a surface opposing said suction cup, wherein said suction cup is positioned such that as said shell structure deforms from the three-dimensional, polyhedral shape into the flattened shape and said top and said bottom caps move together, said suction cup and said surface move together into sealing engagement, and have a volume therebetween.

4. A toy object as in claim 3, wherein said variable timer comprises an adjustable valve which regulates a flow of air into the volume between said first suction cup and said surface.

5. A toy object as in claim 2, wherein said suction cup has an axial bore in fluid communication with a transverse bore, the transverse bore communicating with a surroundings, said valve comprising:

a valve handle;

a valve stem attached to said valve handle, said valve stem having an axial bore and a transverse bore communicating with said axial bore, wherein said valve stem is disposed in said axial bore of said suction cup in a manner which allows said valve stem to rotate, said valve stem being dimensioned and disposed such that as said valve stem rotates in said axial bore, said transverse bore of said suction cup and said transverse bore of said valve stem come into registry, allowing fluid communication from the surroundings to the volume between the suction cup and the surface.

6. A toy object as in claim 2, wherein said surface opposing said suction cup comprises a second suction cup.

7. A toy object as in claim 2, wherein said at least three fingers are symmetrically disposed about said central axis.

8. A toy object as in claim 7, wherein said at least three fingers comprise six said fingers.

9. A toy object as in claim 2, wherein said elastic member lies in a plane.

10. A toy object as in claim 9, wherein said plane is perpendicular to said central axis.

11. A toy object as in claim 2, wherein said elastic member comprises at least one spring.

12. A toy object as in claim 8, wherein said elastic member comprises six springs.

13. A toy object as in claim 12, further comprising at least six rings, each said spring being connected at an end to a particular said ring, so that said six springs and said rings together form a hexagon.

14. A toy object as in claim 13, wherein each said ring comprises a bridle extending from that said ring to an associated said finger.

15. A toy object as in claim 2, wherein each said finger comprises a plurality of panels and a plurality of living hinges, said panels and said living hinges being arranged in alternation along a length of said finger.

16. A toy object as in claim 15, wherein each said finger is joined to said top cap by a first said living hinge and to said bottom cap by a second said living hinge.

17. A toy object as in claim 15, further comprising a plurality of bridles, each said bridle connecting the elastic member to an associated said living hinge.

18. A toy object as in claim 2, wherein said articulated shell structure has a perimeter, and further comprising a plurality of perimeter weights disposed on said perimeter.

19. A toy object as in claim 18, wherein said elastic member lies in a plane perpendicular to said central axis, and said perimeter weights are disposed in said plane.

20. A toy object as in claim 2, wherein said fingers and said bottom cap are formed as an integral unit.

21. A toy object, comprising:

an articulated shell structure having a top cap, a bottom cap, and at least three fingers connecting said top cap and said bottom cap in a manner such that said articulated shell structure can selectively change from a three-dimensional, polyhedral shape into a flattened shape;

biasing means for applying a force to at least some of said fingers, the force tending to urge said shell structure into the three-dimensional, polyhedral shape;

holding means for holding said shell structure in the flattened shape in opposition to the force applied by said biasing means; and regulating means for regulating a period of time during which said holding means holds said shell structure in said flattened shape, so that said period of time during which said holding means holds said shell structure in said flattened shape can be varied.

22. A method of changing a configuration of a toy object, comprising the steps of:

providing the toy object, the toy object having an articulated shell structure deformable between a three-dimensional polyhedral shape and a flattened shape, a releasable lock which, when the shell structure is deformed to a position applies a restraining force to the shell structure to hold the shell structure in the position, and a variable timer which causes the releasable lock to apply the restraining force to the shell structure only during a period of time which can be varied;

applying a force to a portion of said shell structure, the force tending to urge the shell structure into the polyhedral shape;

holding the shell structure in the flattened shape using the releasable lock in opposition to the force applied; and regulating a duration of said holding of the shell structure by the releasable lock in the flattened shape using the variable timer.

* * * * *